US005721711A

United States Patent [19]

Fine et al.

[11] Patent Number: 5,721,711

[45] Date of Patent: Feb. 24, 1998

[54] APPARATUS AND METHOD FOR PRODUCING INVERSE BUBBLES

[76] Inventors: Matthew J. Fine, 8866 N. Lake Dr., Milwaukee, Wis. 53217-1938; Ronald C. LeMay, 8146 N. 105, Milwaukee, Wis. 53224

[21] Appl. No.: 625,234

[22] Filed: Apr. 1, 1996

[51] Int. Cl.[6] ..... H04K 3/00

[52] U.S. Cl. ..... 367/1

[58] Field of Search ..... 367/1, 191; 114/15; 73/53.01; 222/61; 137/44

[56] References Cited

U.S. PATENT DOCUMENTS 5,222,455 6/1993 Furey ..... 114/270

5,283,766 2/1994 Klein ..... 367/1

OTHER PUBLICATIONS

Stong The Amateur Scientist "Curious Bubbles in Which a Gas Enclosure a Liquid Instead of the Other Way Around" from Scientific American, Apr., 1974 Issue, pp. 116–121.

*Primary Examiner*—Daniel T. Pihulic

*Attorney, Agent, or Firm*—Jansson, Shupe, Bridge & Munger, Ltd.

[57] ABSTRACT

An apparatus and method for producing inverse bubbles is disclosed. One embodiment of such apparatus includes a first solution in a container and a second solution in a reservoir above the container. The reservoir has a dispensing aperture and while dispensing drops of the second solution into the container, the aperture and the surface of the first solution are maintained at a substantially constant distance from one another. Another embodiment of the apparatus involves a gun-like device dispensing drops using projectile force. The method involves producing inverse bubbles using an aqueous first solution and an aqueous second solution. Each solution includes a substance for reducing water surface tension. A drop of the second solution is dispensed into the first solution at a velocity such that the drop impacts the surface with a force slightly in excess of the force component of the surface tension of substantially pure water. A liquid containing an inverse bubble is thereby produced.

17 Claims, 4 Drawing Sheets

APPARATUS AND METHOD FOR PRODUCING INVERSE BUBBLES

FIELD OF THE INVENTION

This invention relates generally to bubble production and, more particularly, to production of inverse bubbles.

BACKGROUND OF THE INVENTION

Previously, little was known about an interesting phenomenon involving bubbles, in particular, inverse bubbles. Inverse bubbles have a coating of air surrounding a sphere of water, unlike soap bubbles which have a layer of soapy water around a sphere of air.

The existence of inverse bubbles or antibubbles has been known of for years as evidenced by an article in April, 1974, issue of *Scientific American* magazine entitled "THE AMATEUR SCIENTIST - Curious Bubbles in which a gas encloses a liquid instead of the other way around." Extensive effort was often expended in purifying water and cleaning equipment in an effort to produce inverse bubbles. Despite these efforts, difficulty has been encountered in attempting to consistently reproduce inverse bubbles when and as needed. Additionally, perhaps because of the difficulty in production of inverse bubbles, no known applications have been found for inverse bubbles technology. Thus, research related to inverse bubbles has been very limited and insofar as is known, practical uses for inverse bubble technology do not exist.

At the same time there is ongoing research in a number of areas, including water current evaluation, water treatment and sonar deflection. None of this research has previously investigated the possible use of inverse bubble technology.

Current methods of determining water currents and their paths typically utilize dyes to track currents. However, several problems have been encountered in using such dyes. One of the more common problems associated with dye use is dye diffusion throughout the water. Such diffusion makes it difficult to monitor and follow the current's path.

Likewise, in water treatment, diffusion or dispersion is also a problem, albeit of a different nature. Often it is more beneficial or necessary to treat water at a certain depth. However, to reach such depth it is often necessary to treat the entire volume of water. Alternatively, sophisticated arrangements can be used to position chemicals at a specific depth prior to discharge. These methods are often costly and result in less than desirable treatment of water.

Likewise, in military defense, detection avoidance for vessels and, in particular, submerging vessels is the focus of ongoing extensive research. Sonar, both active and passive, are commonly used to accomplish initial vessel detection. Sonar transmissions, in their simplest sense, are designed to send out a signal. The signal deflects off any potential "contacts" in its path, and returns to a receiver. The key to understanding sonar, both active and passive, can be achieved through comprehension of sonar equations. The sonar equations are based on a relationship or ratio that must exist between the desired and undesired portion of the received energy or signal when some function of the sonar set such as detection or classification is performed. These functions all involve the reception of acoustic energy occurring in a natural acoustic background. Of the total acoustic energy at the receiver, a portion is from the target and is called the signal. The remainder is from the environment and is called "noise." The oceans are filled with noise sources such as breaking waves, marine organisms, surf, and distant shipping, which combine to produce what is known as "ambient noise." In contrast, "soft noise" is produced by machinery within the receiving platform and by motion of the receiving platform through the water. Further, in active systems, scatterers such as fish, bubbles, and the sea surface and bottom produce an unwanted return called "reverberation," which contributes to the masking of the desired signal.

There has been an ongoing effort to either avoid detection or mask or alter the expected returned signal of a vessel. New methods and systems or arrangements which address some of these disadvantages would be important advances in the arts.

OBJECTS OF THE INVENTION

It is an object of the invention to provide an apparatus and method which overcomes some of the problems and shortcomings of the prior art.

Another object of the invention is to provide an apparatus and method for producing inverse bubbles.

Yet another object of the invention is to provide an apparatus and method which consistently produces inverse bubbles.

Yet another object of the invention is to provide a method and apparatus which simplifies the production of inverse bubbles.

Still another object of the invention is to provide a method for deflecting a sonar signal intended to detect a submerged vessel.

Yet another object of the invention is to provide a method for treating water.

Another aspect of the invention includes providing a method for determining the flow of currents in a body of water.

How these and other objects are accomplished will become more apparent from the following descriptions and from the drawings.

SUMMARY OF THE INVENTION

The invention includes a method and apparatus for producing inverse bubbles. It is believed that various embodiments of the inventive method enable production of inverse bubbles for various purposes. The method and apparatus overcome certain problems and deficiencies of the prior art, including those outlined above. An important aspect of this invention is the ability to consistently produce a liquid containing inverse bubbles. Another important aspect of the invention is to provide for release of the liquid in a manner to deflect a sonar signal intended to detect a submerged vessel. Yet another aspect of the invention involves a method of producing inverse bubbles in a manner intended to enable treatment of water. Still another aspect of the invention involves a method of producing inverse bubbles in a manner intended to enable monitoring of current flow.

The apparatus of the present invention typically includes a first solution in a container, the first solution having a surface, and a second solution in a reservoir above the container. The reservoir commonly includes a dispensing aperture. During dispensing of the second solution into the container, the surface of the first solution and the aperture are maintained at a substantially constant distance from one another.

In one embodiment, the container preferably has an overflow port which allows for maintenance of the distance between the surface of the first solution and the aperture in a substantially constant manner. The reservoir is preferably mounted on a support stand and is movable with respect thereto. Such an arrangement further assists in maintaining the distance between the surface of the first solution and the aperture substantially constant. The reservoir can also be fitted with a valve for controlling the flow of the second solution through the aperture.

The method of the present invention involves utilization of an aqueous first solution and an aqueous second solution. Each of these solutions includes a substance for reducing water surface tension. The first solution has a surface, and the second solution is dispensed into the first solution. The method involves dispensing a drop of the second solution into the first solution at a velocity such that the drop impacts the surface with a force slightly in excess of the force component of the surface tension of substantially pure water. This results in the production of a liquid containing an inverse bubble.

One way to produce inverse bubbles involves orientation of the second solution in a reservoir above the surface of the first solution. Dispensing involves releasing the second solution from the reservoir at a height in excess of 1.0 cm above the surface. Preferably the height is between 1.0 cm and 2.0 cm so that gravity provides the appropriate velocity. In highly preferred embodiments the height is about 1.8 cm.

However, gravity formation is not the only way to produce an inverse bubble. The drop of the second solution may be dispensed using projectile force. Drop dispensing is preferably from a gun-like device. Such device may be directly above the surface of the first solution or may be angled with respect to such surface. In the latter instance, the device may be at a position other than over the first solution vessel, i.e., at a position on an axis spaced laterally away from and outside the vessel walls.

A more specific aspect of the invention involves a method of producing inverse bubbles utilizing a reservoir having a top closure and a bottom panel with an aperture therethrough. Such a method accomplishes dispensing of the second solution into the first solution by slightly opening the closure, thereby permitting gas (e.g., air) to enter the reservoir and the drop to escape through the aperture.

Although the inventive method encompasses the production of a single inverse bubble from a single drop, preferably, the drop is a first drop and the method includes dispensing a second drop at a minimum time interval after dispensing the first drop. Time intervals of not less than about one second are preferred.

Additionally, a plurality of drops of the second solution can be dispensed into the first solution while the elevation of the surface of the first solution is maintained substantially constant such that a liquid containing a plurality of inverse bubbles is produced. Preferably, the first solution is in a container and the elevation of the surface of the first solution is maintained substantially constant by forming a hole in the container at the elevation.

Yet another aspect of the inventive method involves releasing the liquid into sea water adjacent to a submerged vessel, thereby deflecting a sonar signal intended to detect the submerged vessel. And that is not all. The inventive method can include other steps depending on the use. For instance, the method can involve utilizing solutions wherein at least one of the solutions includes a water treatment chemical. One such method can include the steps of adding a water treatment chemical to the second solution, thereby forming a treatment solution. Preferably, such addition is accomplished prior to dispensing the second solution. It is preferred in such method that the first solution is a water to be treated.

Yet another possibility involves use of solutions wherein at least one of the solutions includes a dye. Such method can include the steps of adding a dye to the second solution, thereby forming a disclosing solution. Preferably, such addition is accomplished prior to dispensing the second solution. It is contemplated that the first solution is a body of water having water current present therein.

Further details of the invention are set forth in the following detailed description and in the drawings.

DETAILED DESCRIPTION OF PREFERRED EMBODIMENTS

Figure 1:
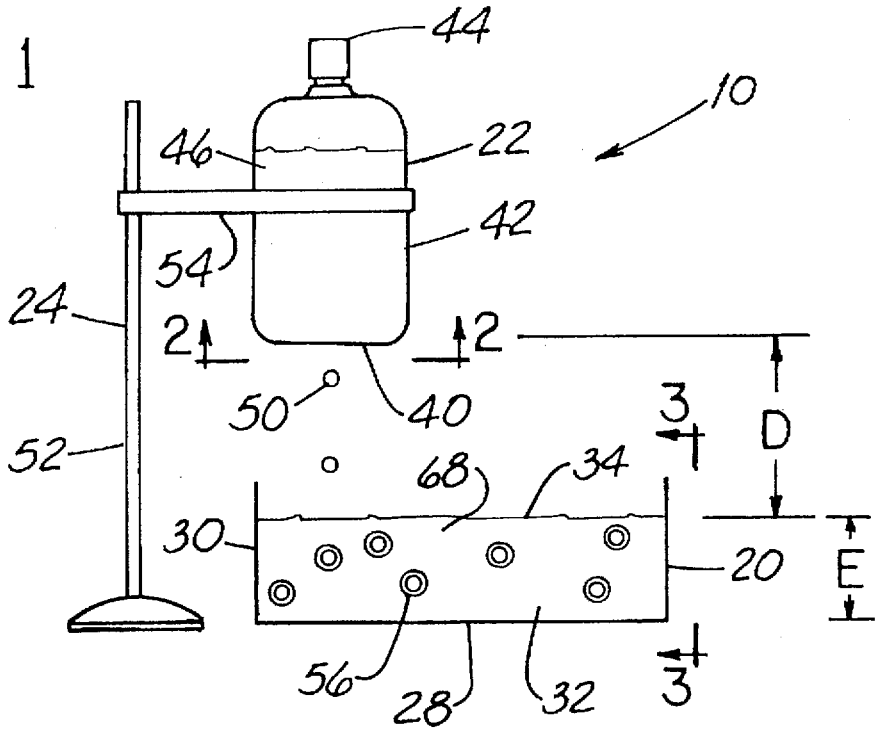
FIG. 1 is an elevation view of an embodiment of the inventive apparatus.
Figure 3:
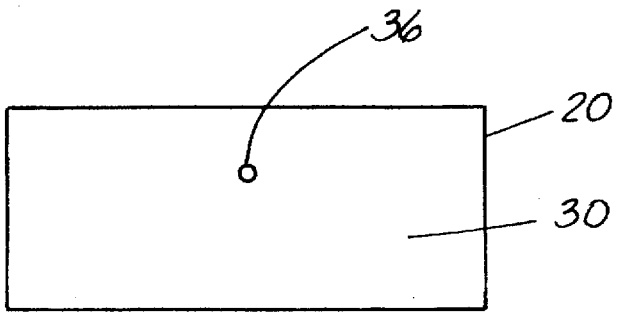
FIG. 3 is an elevation view of the apparatus container taken along the viewing plane 3—3 of FIG. 1.

As shown in FIG. 1, the apparatus 10 of the present invention includes a container 20, a reservoir 22 and a support stand 24. Container 20 includes a bottom wall 28 and side walls 30. A first solution 32 is disposed in container 20 and includes a surface 34. An elevation E is defined as the distance between bottom wall 28 and surface 34. Additionally, as best seen in FIG. 3, an overflow port or hole 36 is positioned in a side wall 30 of container 20. Preferably, overflow port 36 is positioned at elevation E. The function of overflow port 36 is discussed below.

Figure 2:
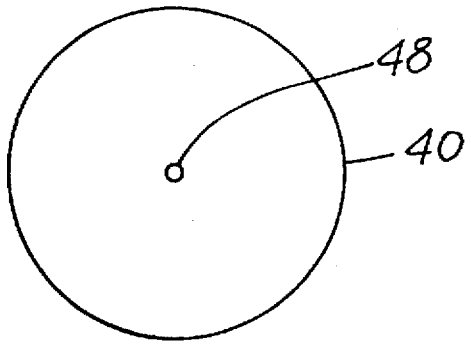
FIG. 2 is a bottom plan view of the reservoir taken along the viewing plane 2—2 of FIG. 1.

Reservoir 22 includes a bottom panel 40, side walls 42 and, preferably, a top closure 44. The reservoir 22 contains a second solution 46. As best seen in FIG. 2, bottom panel 40 includes a dispensing aperture 48. Dispensing aperture 48 is adapted to preferably release individual drops 50 of second solution 46.

Support stand 24 includes a support member 52 and an arm member 54. Preferably, arm member 54 is adjustably secured to support member 52 for vertical movement therealong. Arm member 54 is adapted to grasp or secure reservoir 22 in an adjustably fixed position. Preferably, as shown in FIG. 1, support stand 24 provides for positioning of reservoir 22 above container 20 such that second solution 46 can be dispensed into first solution 32 as individual drops 50 such that inverse bubbles 56 are formed. The distance between dispensing aperture 48 and surface 34 of first solution 32 is defined as D in FIG. 1.

To produce inverse bubbles consistently, a steady supply of moderate sized drops is required. The drops should be independent of one another, and should be released at a constant rate, with approximately one second between each drip.

Further, to produce inverse bubbles from a first and second aqueous solution it is preferable to include a substance for reducing water surface tension. The surface tension of "pure" water, depending on the temperature, is about 73 dyne/cm. Any object striking the water surface with slightly in excess of 73 dyne of force should be sufficient to overcome the water surface tension.

However, reduction or decrease in surface tension allows the drop to more easily pierce the surface. One readily available substance which reduces surface tension of water is soap. As can be seen from TABLE 1 below, the amount of soap included in the solutions is not critical, only its presence is preferred.

TABLE 1

| Amount of Soap | Water Height in Microtubule |
|---|---|
| 0 grams | 1.83 centimeters |
| .0082 grams | .7625 centimeters |
| 82 grams | .61 centimeters |

As can be seen, even a minute amount of soap drastically decreases the surface tension of water. (Surface tension can be determined by evaluating the height of the water's meniscus in the microtubule.) Additional soap does little to lower the surface tension.

Any one of three events can occur when a drop of water strikes the surface of a volume of water, namely:

1. Nothing, if the force of impact is somewhat less than 73 dyne or, due to the presence of a substance reducing surface tension, less than some lower surface tension.

2. An inverse bubble can be formed. To do this, the drop must have a force of slightly in excess of the surface tension for that water sample, e.g., slightly in excess of 73 dyne.

3. A surface-floating globule can be formed. This will occur if the force is about equal to the surface tension for that water sample, e.g., about equal to 73 dyne.

Another advantage of using soap is that it lubricates the water, letting the drop slip below the surface. Additionally, it is noteworthy to mention that the more soap that is in the solution around an inverse bubble and in the inverse bubble, the more flexible and durable the inverse bubble will be. Jostling the solution will have less of an effect than if there is less soap present.

Additionally, one may also use sodium chloride (NaCl), i.e., salt, to reduce surface tension but it should be understood that salt is much less effective than soap or detergent for that purpose. The primary purpose of salt as described for use herein is to change the density of water. TABLE 2 below illustrates the reduction in surface tension as sodium chloride is introduced.

TABLE 2

| Amount of NaCl | Water Height in Microtubule |
|---|---|
| 0 grams | 1.83 centimeters |
| 0.2 grams | 1.0675 centimeters |
| 20 grams | 1.0675 centimeters |

With respect to either TABLE 1 or TABLE 2, the amount of water used is in the range of 3–5 gallons.

Preferably, the amount of sodium chloride in the first and second solutions should be about the same. Difficulties may be encountered if one solution contains more or less sodium chloride than the other. And it should be understood that any of several known surface tension reducing substances can be used to accomplish surface tension reduction and facilitate inverse bubble production.

Figure 5:
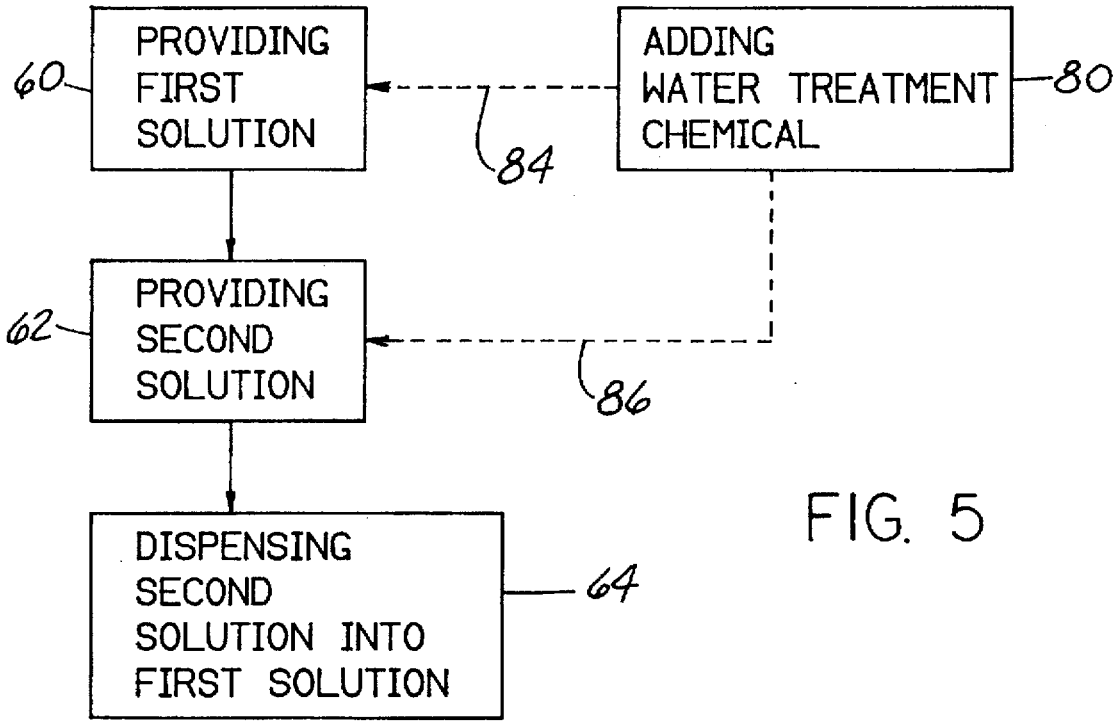
FIG. 5 is a flow chart depicting the basic method modified by addition of a water treatment chemical.
Figure 6:
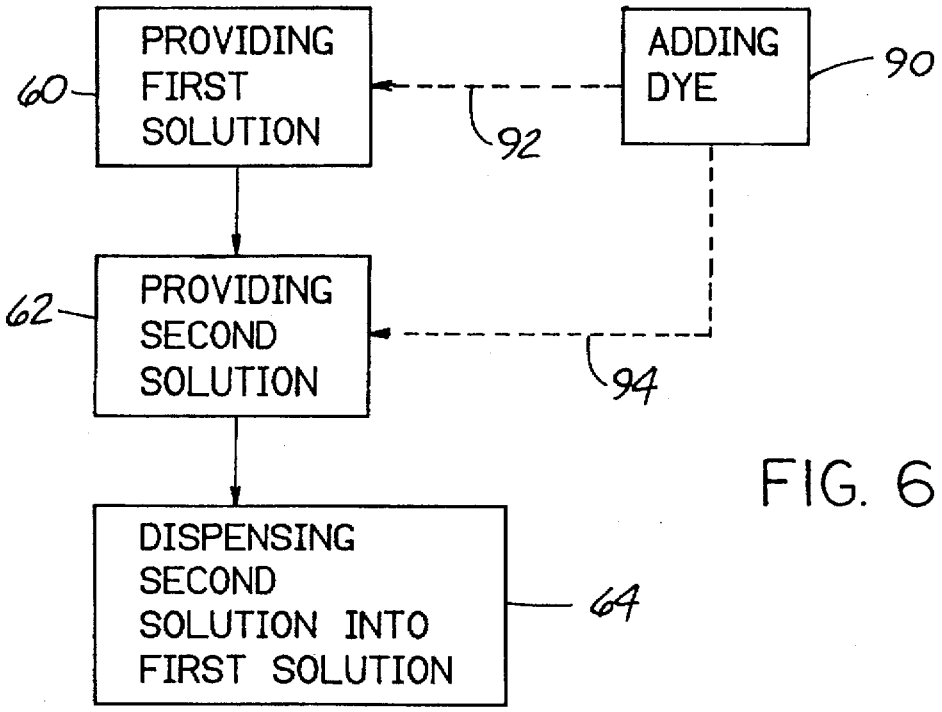
FIG. 6 is a flow chart depicting the basic method modified by addition of a dye.

As seen in the Flow Charts of FIGS. 5 and 6, after a first and second solution are provided as designated by the symbols 60 and 62, respectively, production of inverse bubbles involves dispensing the second solution into the first solution as shown in FIGS. 5 and 6 as represented by symbol 64. Dispensing a drop 50 of the second solution into the first solution should be at a velocity such that the drop impacts surface 34 with a force slightly in excess of the surface tension of substantially pure water. As best seen in FIG. 1, a liquid 68 containing an inverse bubble 56 is produced.

One aspect of the inventive method utilizes the second solution in reservoir 22 positioned above surface 34. The height or distance D must be sufficient to cause a drop to pierce the water's surface without destroying the inverse bubble. The height at which second solution 46 should be released or dispensed into first solution 32, i.e., the distance D between dispensing aperture 48 and surface 34, is in excess of about 1.0 cm above the surface. Preferably, the distance D is between 1.0 cm and 2.0 cm. It is highly preferred that the distance D be about 1.8 cm.

To assist in dispensing, top closure 44 can be utilized as a valve and be manipulated to slightly open closure 44, thereby permitting gas to enter reservoir 22 and allowing a drop 50 to escape through aperture 48. Preferably, additional drops are dispensed at a minimum time interval after dispensing the first drop. This time interval should preferably not be less than about one second.

It is preferable during inverse bubble production to maintain the elevation of surface 34 substantially constant. The elevation of surface 34 is maintained substantially constant by positioning overflow port or hole 36 in a side wall of container 20 at the elevation.

Figure 4:
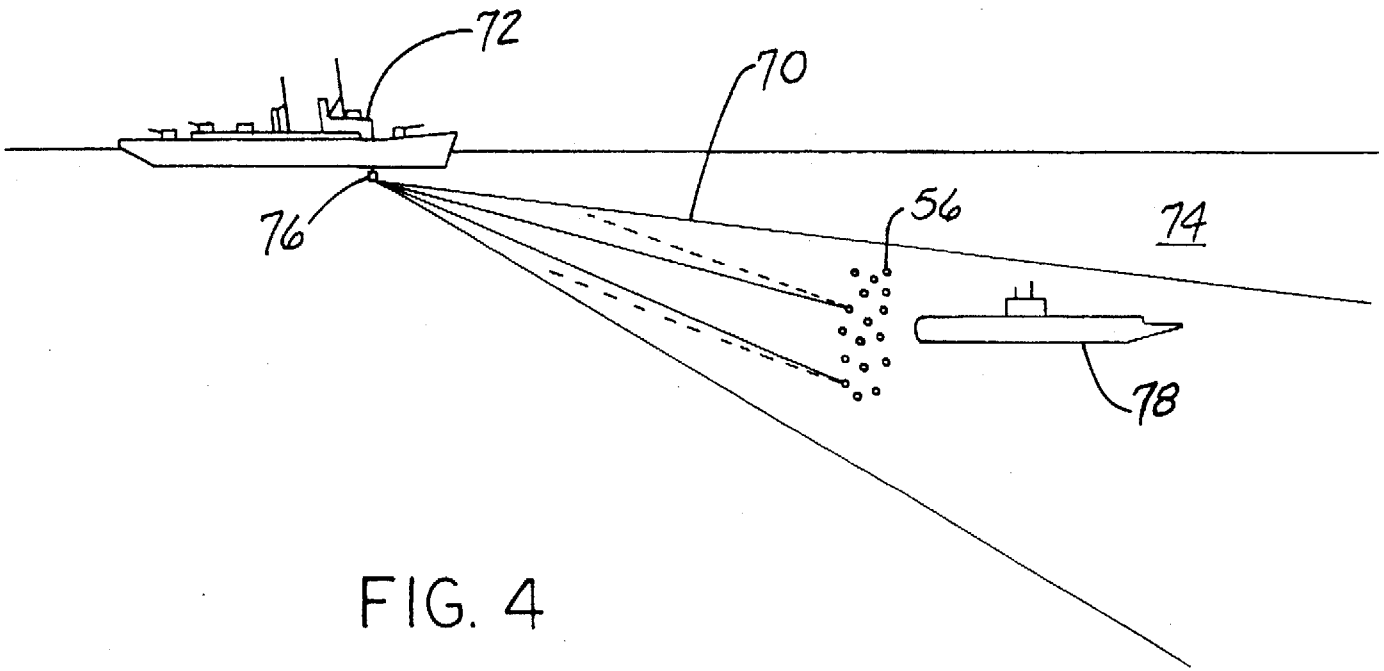
FIG. 4 is a representation of a submerged vessel shielded from sonar detection by a "curtain" of inverse bubbles.

It is intended that the inventive method of production of inverse bubbles find utility in a number of practical applications. For instance, in military defense, inverse bubble production may be used to assist in deflection of a sonar signal. As best seen in FIG. 4, a sonar signal 70 is produced by a vessel 72. Such sonar signal 70 is sent out through water, typically sea water 74. When a sonar signal encounters an object, the signal is reflected and a receiver 76 on vessel 72 detects such reflected signal. An analysis of the signal is then made to determine if the object is a possible target, such as a submerged vessel 78.

It is intended that one of the uses for the new method of production of inverse bubbles may further involve releasing liquid 68 which contains inverse bubbles 56 therein into sea water 74 adjacent to a submerged vessel, thereby deflecting sonar signal 70 intended to detect the submerged vessel, as shown in FIG. 4.

As depicted in the Flow Chart of FIG. 5, it is further contemplated that the inventive method be utilized to treat water. As represented by symbol 80, the inventive method can further include the addition of a water treatment chemical to the first solution 32 as indicated by line 84 or to the second solution as indicated by line 86. Preferably, the water treatment chemical is added to the second solution prior to dispensing, thereby forming a treatment solution. This second solution is then dispensed directly into a container or body of water to be treated.

Alternatively, as depicted in the Flow Chart of FIG. 6, it is further intended that another use for the inventive method involve monitoring of water currents. As depicted by symbol 90, the inventive method can further include the addition of a dye to the first solution 32 as indicated by line 92 or to the second solution 46 as indicated by line 94. Preferably, the dye is added to the second solution prior to dispensing, thereby forming a disclosing solution. This disclosing solution can then be dispensed into the first solution which can be a container or more likely a body of water which contains currents to be monitored.

Figure 7:
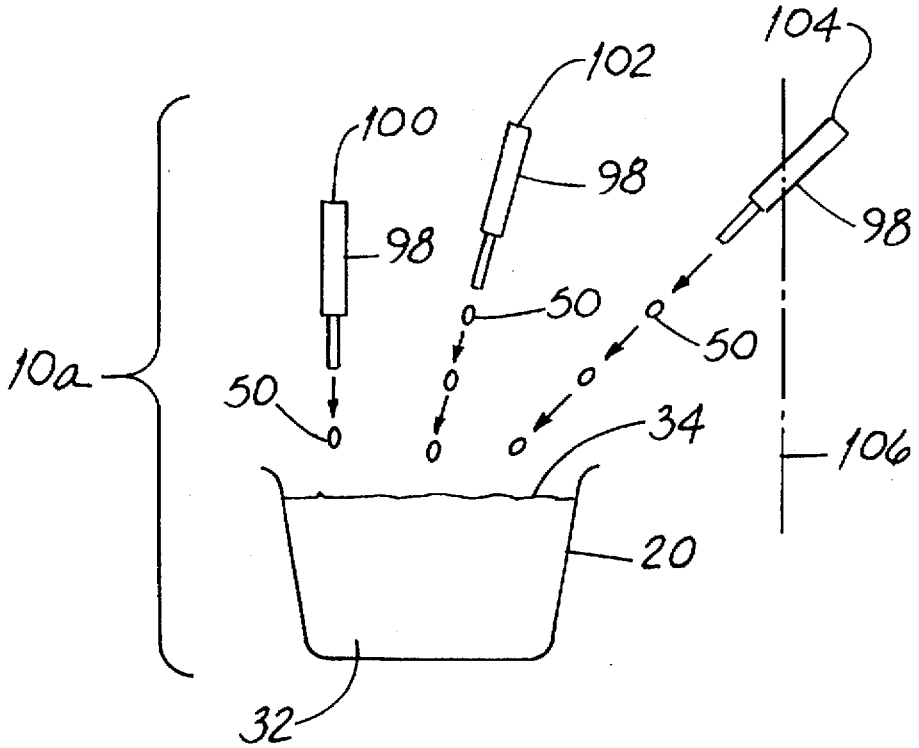
FIG. 7 is an elevation view of another embodiment of the apparatus involving dispensing drops with projectile force using a gun-like device.

Referring again to FIG. 1 and particularly to FIG. 7, gravity formation is not the only way to produce an inverse bubble. Another apparatus 10*a* involves a container 20 holding a first solution 32 having a surface 34. The drop 50 of the second solution 46 is dispensed using projectile force. Drop dispensing is preferably from a gun-like device 98. Such device 98 may be directly above the surface 34 of the first solution 32 (and closely proximate thereto as at the position 100 or such device 98 may be angled with respect to such surface 34 as at the position 102. In the latter instance, the device 98 may be at a position 104 other than over the container 20, i.e., at a position 104 on an axis 106 spaced laterally away from the container 20.

While the principles of the invention have been described in connection with specific embodiments, it is to be understood clearly that such embodiments are by way of example and are not limiting.

What is claimed is:

1. In a method for producing inverse bubbles using an aqueous first solution and an aqueous second solution and wherein (a) each solution includes a substance for reducing water surface tension, (b) the first solution has a surface, and (c) the second solution is dispensed into the first solution, the improvement comprising:

providing the first solution in a container;

providing the second solution in a reservoir above the container, the reservoir being mounted on a support stand and including a dispensing aperture below the second solution and a closure above the dispensing aperture;

opening the closure to permit gas to enter the reservoir; thereby dispensing a drop of the second solution into the first solution at a velocity such that the drop impacts the surface with a force slightly in excess of the force component of the surface tension of substantially pure water, whereby a liquid containing an inverse bubble is produced.

2. The method of claim 1 wherein the dispensing step includes releasing the second solution from the reservoir at a height in excess of 1.0 cm above the surface.

3. The method of claim 2 wherein the height is between 1.0 cm and 2.0 cm.

4. The method of claim 3 wherein the height is about 1.8 cm.

5. The method of claim 1 wherein the drop is a first drop and the dispensing step includes dispensing a second drop at a minimum time interval after dispensing the first drop.

6. The method of claim 5 wherein the time interval is not less than about one second.

7. The method of claim 1 wherein the dispensing step includes:

dispensing a plurality of drops of the second solution into the first solution, each drop being dispensed at a velocity such that it impacts the surface with a force slightly in excess of the force component of the surface tension of substantially pure water; and maintaining the elevation of the surface substantially constant, whereby a liquid containing a plurality of inverse bubbles is produced.

8. The method of claim 7 wherein the container has a hole therein at the elevation, whereby the elevation of the surface is maintained substantially constant.

9. The method of claim 8 including the steps of: releasing the liquid into sea water adjacent to a submerged vessel, thereby deflecting a sonar signal intended to detect the submerged vessel.

10. The method of claim 7 wherein the method further includes adding a water treatment chemical to the second solution, thereby forming a treatment solution.

11. The method of claim 7 wherein preceding dispensing, a water treatment chemical is added to the second solution, thereby forming a treatment solution.

12. The method of claim 7 wherein the method includes adding a dye to the second solution, thereby forming a disclosing solution.

13. The method of claim 7 wherein preceding dispensing, a dye is added to the second solution, thereby forming a disclosing solution.

14. In an apparatus for producing inverse bubbles and including a first solution in a container and a second solution in a reservoir above the container, the improvement wherein:

the reservoir is mounted on a support stand and has a dispensing aperture below the second solution and a releasable closure above the second solution; and the support stand maintains the reservoir at a substantially constant distance above the container.

15. The apparatus of claim 14 wherein the first solution has a surface, the aperture is at a distance from the surface and the container has an overflow port maintaining the distance between the aperture and the surface substantially constant.

16. The apparatus of claim 14 wherein the reservoir is movable with respect to the support stand for maintaining the distance substantially constant.

17. The apparatus of claim 14 wherein opening the closure controls the rate of flow of the second solution through the aperture.

* * * * *